US011577138B1

(12) United States Patent
Race

(10) Patent No.: US 11,577,138 B1
(45) Date of Patent: Feb. 14, 2023

(54) ADJUSTABLE WRIST SUPPORT STABILIZER THAT KEEPS THE WRIST STRAIGHT AT IMPACT DURING THE GOLF-SWING

(71) Applicant: Erick H. Race, East Lyme, CT (US)

(72) Inventor: Erick H. Race, East Lyme, CT (US)

( * ) Notice: Subject to any disclaimer, the term of this patent is extended or adjusted under 35 U.S.C. 154(b) by 0 days.

(21) Appl. No.: 17/447,744

(22) Filed: Sep. 15, 2021

(51) Int. Cl.
*A63B 69/36* (2006.01)
*A63B 69/00* (2006.01)

(52) U.S. Cl.
CPC ..... *A63B 69/0059* (2013.01); *A63B 69/36* (2013.01)

(58) Field of Classification Search
CPC ..... A63B 69/0059; A63B 69/36
USPC .... 473/62, 63, 205, 212, 213, 214, 276, 458
See application file for complete search history.

(56) References Cited

U.S. PATENT DOCUMENTS 3,606,342 A 9/1971 Albertson, Jr.
3,698,389 A * 10/1972 Guedel ..... A61F 5/013 473/214
3,700,245 A 10/1972 Nannini
4,176,840 A * 12/1979 Lanning ..... A63B 69/0046 473/213
4,384,571 A * 5/1983 Nuzzo ..... A61F 5/05875 602/22
4,502,688 A 3/1985 Papp
5,180,169 A 1/1993 Choy
5,207,430 A 5/1993 Goins
D337,180 S * 7/1993 Bailey ..... D24/171
5,453,064 A * 9/1995 Williams, Jr. ..... A63B 23/16 2/161.1
5,456,650 A * 10/1995 Williams, Jr. ..... A63B 21/4025 473/212
5,492,331 A 2/1996 Kawakami
5,501,464 A 3/1996 Dalbo
5,511,788 A * 4/1996 Manley ..... A63B 69/0059 473/212
5,634,854 A 6/1997 Albertsson
5,797,803 A 8/1998 Jung
5,823,886 A 10/1998 Murray
5,827,126 A 10/1998 Lee
7,220,188 B2 5/2007 Lee
7,510,480 B2 3/2009 Lesko
8,801,531 B2 8/2014 Buchanan et al.
9,233,290 B2 1/2016 Woody
9,387,111 B2 * 7/2016 Klutts ..... A61F 5/0118
9,795,852 B2 * 10/2017 Shew ..... A63B 69/0059
D810,220 S * 2/2018 Ahn ..... D21/791
2007/0155523 A1 * 7/2007 Lesko ..... A63B 69/3632 473/212
2009/0094730 A1 4/2009 Cheng
2010/0100998 A1 4/2010 Lisa
2011/0224009 A1 * 9/2011 Shan ..... A63B 69/0059 473/213
2012/0190470 A1 7/2012 Sanati
(Continued)

*Primary Examiner* — Nini F Legesse
(74) *Attorney, Agent, or Firm* — Dunlap Bennett & Ludwig, PLLC

(57) ABSTRACT

A golf aid for preventing improper wrist bending during a golf stroke. The golf aid provides a wrist wrap with a stabilizer the moves between a retracted position and an extended position spanning the carpal bones, preventing anterior bending of the wrist of a wearer. In the retracted position, the stabilizer is housed in a pocket of the wrist wrap and does not impinge or obstruct the freedom of movement of the wrist.

10 Claims, 3 Drawing Sheets

(56) References Cited

U.S. PATENT DOCUMENTS

| | | | | |
|---|---|---|---|---|
| 2014/0221114 | A1* | 8/2014 | Woody | A63B 69/0059<br>473/213 |
| 2017/0182392 | A1* | 6/2017 | Middleton | A63B 69/0002 |

* cited by examiner

ADJUSTABLE WRIST SUPPORT STABILIZER THAT KEEPS THE WRIST STRAIGHT AT IMPACT DURING THE GOLF-SWING

BACKGROUND OF THE INVENTION

The present invention relates to athletic accessories and, more particularly, to an adjustable wrist support stabilizer that keeps the wrist straight at impact during the golf-swing.

Amateur golfers tend to bend their leading wrist at impact, this tendency is colloquially referred to as "flipping", and so the club 'flips' underneath the ball, almost scooping the ball so that the club-head moves past the hands at or before impacting the ball. As a result, the ball is struck by the club-head either slightly upward of or parallel to the ground as the wrist is hinged during follow through. Flipping causes a lack of compression, which results in shorter ball distance as club-head power is lost before contact with the ball. Moreover, flipping urges the clubface end upward, rotated from an open position to a closed position, causing inconsistent clubface contact and thus erratic ball flight such as slicing, hooking, pulling, and pushing the ball. Furthermore, flipping can also result in both fat and thin shots when the club strikes the ground before the hitting the ball or when the club impacts the ball as the club is slightly on the upswing.

Most amateur golfers do not have the time to practice every day or have time and money for private instructions to overcome this problem. And experience has shown that many hours of practice time on the range is required for learning the proper technique to prevent flipping. Sure, there are devices and/or clubs specifically designed to help overcome this problem, but they are designed only for practice range use and not conducive to the playing of competitive golf, and, again, demand time and patience; two things many novice golfers do not have a surplus of.

Accordingly, there is a need for an adjustable wrist support stabilizer that physically prevents the user's wrist from hinging forward prior to contact with the golf ball, thereby keeping the wrist straight through the golf-swing, putting a stop to flipping.

The wrist stabilizer allows the golfer to grip and swing the club in a normal manner but as the club comes down to strike the ball the wrist is prevented from hinging or bending forward or anterior relative to the forearm. This forces the hands to pass or lead the club head through impact which also results in the shaft leaning toward the target with the lead (non-pivoted) wrist pointed toward the target, whereby the club-head which is moving downward strikes the ball first before the ground providing compression against the ground for maximum distance relative to the power in the swing. The clubface is square at impact allowing the hands to turn naturally and the body to follow through with the chest toward the target at the end of the swing.

Prior to this invention, the only way to correct flipping was to spend hours of practice on the driving range or in private instruction. Given this product is designed to help amateur golfers who do not have the time or possibly the money to spend on the range/instructions, it would be advantageous to the sport of golf. Furthermore, the present invention can be used both on the range and on the course; being able to use while playing the game, saving time, and improving the level of enjoyment for the novice golfer while on the golf course. And so, by seeing the improvement during game play the user can see results in an actual golf shot, increasing their enjoyment of the game and allowing for increased time playing rather than practicing.

SUMMARY OF THE INVENTION

In one aspect of the present invention, a device provides a cuff portion adapted to wrap around a wrist of a wearer; and a stabilizer operatively associated with the cuff portion to move between a retracted position and an extended position adjacent a majority of the carpal bones said wrist.

In another aspect of the present invention, the device further provides wherein the retracted position is disposed superior relative to the majority of said carpal bones; a pocket along the cuff portion, wherein the retracted position houses the stabilizer substantially in the pocket; a wrap portion connected to the cuff portion in such a way as to be movable between an unwrapped condition and a wrapped condition; a first connector disposed along an outer portion of the pocket; and a second connector disposed along an outer portion of the wrap portion, wherein the first connector and the second connector are attachable in the wrapped condition, wherein the stabilizer and the pocket are elongated, wherein the first connector spans the pocket for stabilizing the pocket, wherein the first connector extends from a proximal portion on one side of a width of the pocket and a distal portion on an opposing side of the width of the pocket; a lip perpendicularly extending from and out of plane with a distal end of the stabilizer, wherein a longitudinal length of the stabilizer is up to three inches, wherein the majority of the carpal bones are all of said carpal bones, and wherein the extend position is superior relative to metacarpophalangeal joint of said wrist.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a golf aid for preventing improper wrist bending during a golf stroke. The golf aid provides a wrist wrap with a stabilizer the moves between a retracted position and an extended position spanning the carpal bones, preventing anterior bending of the wrist of a wearer. In the retracted position, the stabilizer is housed in a pocket of the wrist wrap and does not impinge or obstruct the freedom of movement of the wrist.

Figure 5:
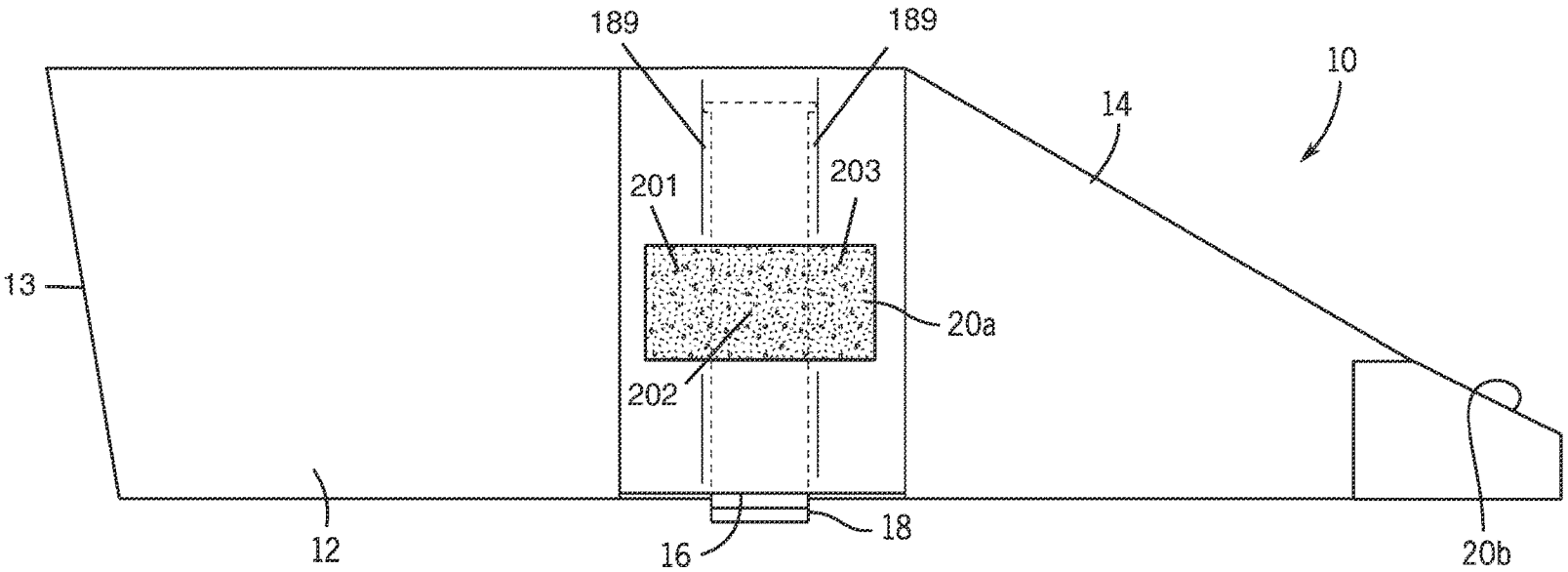
FIG. 5 is a front elevation view of an exemplary embodiment of the present invention, shown in an unwrapped condition.

Referring the FIGS. 1 through 6, the present invention may include a golf aid 10 providing a cuff portion 12 and a wrap portion 14 radially extending from the cuff portion 12 so that the wrap portion 14 may move between an unwrapped condition (FIGS. 3 and 4) and a wrapped condition (FIGS. 1 and 2) around an outer surface of the cuff portion 12. In certain embodiments, the wrap portion 14 and the cuff portion 12 are part of a planar material that can occupy a flat condition, as illustrated in FIG. 5. Thus, moving the golf aid 10 from the unwrapped condition to the wrapped condition may entail applying the inner surface of a proximal end 13 of the golf aid 10 against a portion of the user's wrist, and then proceeding to wrap the remaining portions of the golf aid 10 around the wrist. Alternatively, the cuff portion 12 may be formed in a tubular shape, and so the user 22 would slide their lead hand and wrist through the lumen of the tubular cuff portion 12, and then proceed to wrap the wrap portion 14 around the cuff portion 12 as described above to get to the wrapped condition. In tube form, the cuff portion 12 may have a wider opening on the upper or superior side of the cuff portion 12. The material of the cuff portion 12 and the wrap portion 14 may be any durable, flexible material to facilitate the above teachings, such as but not limited to stretch fabric and the like.

Along the outer surface of the golf aid 10 may be a first connector 20*a* and along the outer surface of a distal end 15 of the wrap portion may be a second connector 20*b*, wherein the first and second connectors 20*a* and 20*b* complementarily removably attach to each other to form an attached condition, securing the wrapped condition around the wrist of the user 22. In certain embodiments, the first and second connectors 20*a* and 20*b* may be any complementary connectors that allow one object to adjustably and removably connect to second object (e.g., hook and loop fasteners, snaps, zippers, adhesives, etc.). Hook and loop portions would provide an adjustability through affording a selective attachment point; though, an array of snaps may also provide the selective adjustability.

A proximal end of the wrap portion 14 may provide a pocket 16 dimensioned and adapted to slidably receive a stabilizer 18. The stabilizer 18 and thus the pocket 16 may be elongated, meaning that a longitudinal length is greater than its corresponding width. The ratio of length to width may be 2:1 or greater, such as 6:1.

Figure 3:
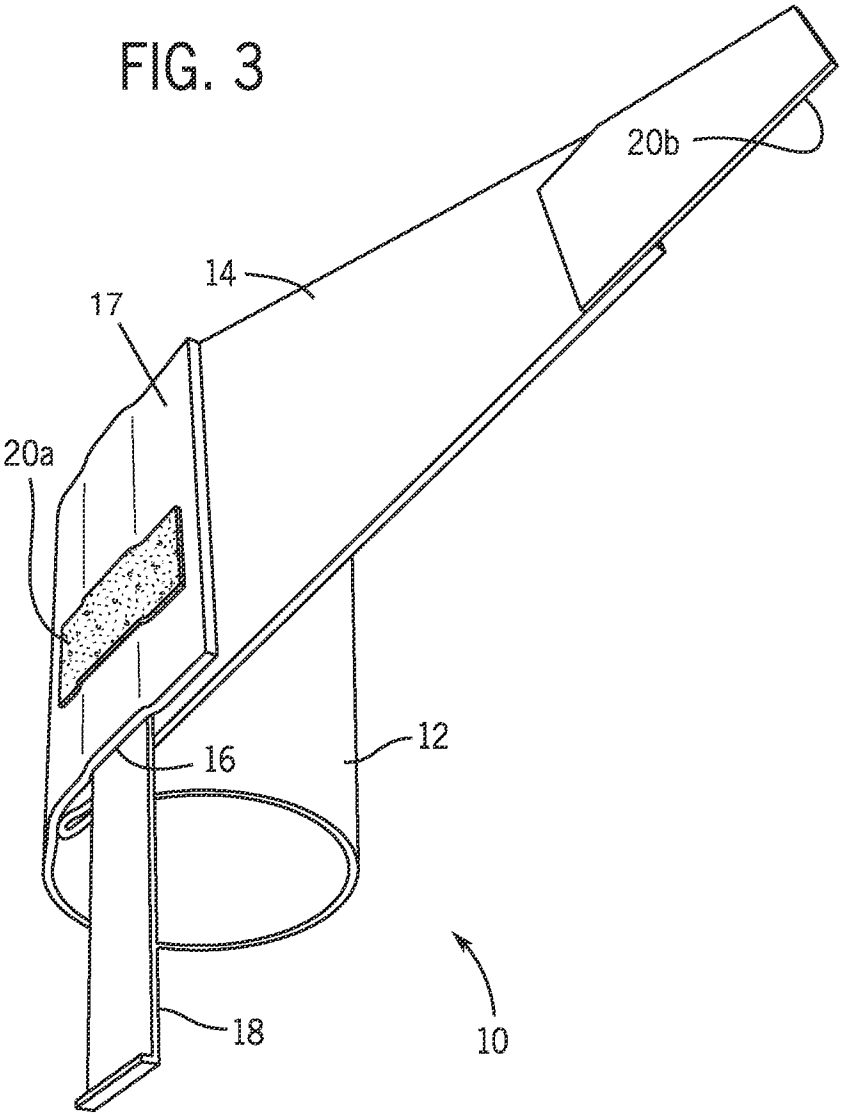
FIG. 3 is a front perspective view of an exemplary embodiment of the present invention, shown in the extended position.

The pocket 16 may be formed through the overlay of a pocket layer 17 over the proximal end of the wrap portion 14, wherein the pocket layer 17 is connected to said proximal end in a spaced apart manner, wherein the pocket is defined between such connections. In certain embodiments, a distal portion of the cuff portion 12 may by the pocket layer 17, overlapping the proximal end of the wrap portion 14, as illustrated in FIG. 3. It is understood that the pocket 16 need not be formed through overlapping, but rather could be a cavity in the material used to form the cuff portion 12 and/or the wrap portion 14 of the golf aid 10.

The pocket 16 may be configured to house substantially the entire (elongated) length of the stabilizer 18, wherein the pocket 16 aligns with a longitudinal axis of the forearm, and wherein the pocket 16 prevents the stabilizer 18 from rotating or pivoting away from this alignment with the longitudinal axis of the forearm. In embodiments with an overlapping layer, three of the four edges of said layer may be sewn to the wrap portion 14, whereby a fourth edge is left unsewn, forming an opening for the pocket 16.

The first connector 20*a* may be placed at the location of the pocket 16, and in certain embodiments may span a width of the pocket 16 so as to facilitate preventing a housed stabilizer 18 from pivoting laterally (toward and away from a thumb associated with the wrist the golf aid 10 is being worn on) as well as longitudinally (away from the back of the hand of the wearer). The first connector 20*a* may have a proximal portion 201 on one side of the pocket 16, a middle portion 202 overlapping the pocket 16, and 203 distal portion on another side of the pocket 16, as illustrated in FIG. 5.

Though importantly, the stabilizer 18 can slidably move between a retracted position and an extended position, wherein in the retracted position the stabilizer 18 is disposed upward or superior relative to the carpal bones of a wearer, and wherein in extended position the stabilizer 18 is adjacent said carpal bones.

The carpal bones (the sole cluster of bones in the wrist between the radius and ulna and the metacarpus) are the eight small bones that make up the wrist (or carpus) that connects the hand to the forearm. In both human anatomy and for the purpose of the present invention, the main role of the wrist is to facilitate effective positioning of the hand through providing freedom of movements at the wrist so as to pivot—about the carpal bones relative to said longitudinal axis of the forearm—between a dorsal/anterior position (wherein the back of the hand is forward of the forearm) and a palmar/posterior position (wherein the forearm is further forward relative to the hand).

Through placement of the pocket 16 and thus the extended stabilizer 18 along a dorsal/anterior portion of the forearm/wrist, the wrist of the user 18 is prevented from pivoting forward since the stabilizer 18 spans from the radius and ulna to the metacarpus.

Figure 6:
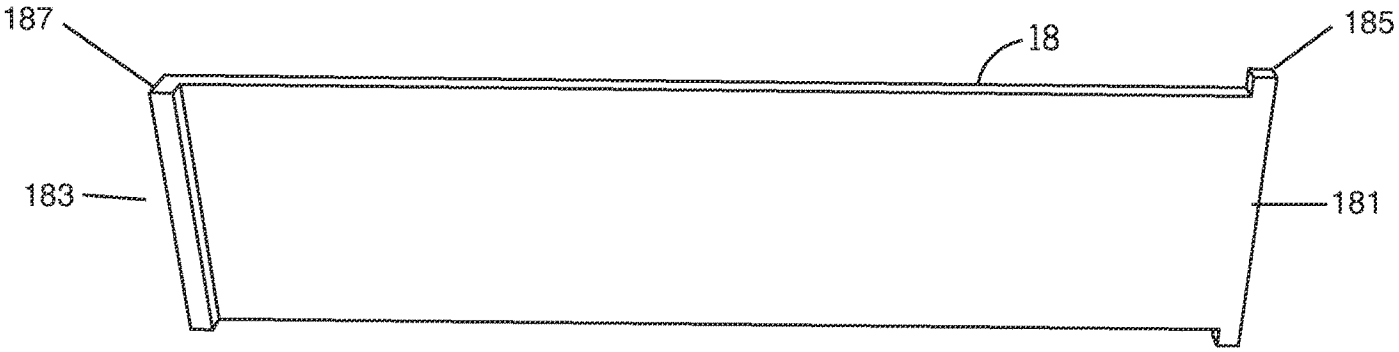
FIG. 6 is a perspective view of an exemplary embodiment of a stabilizer component of the present invention.

Referring to FIG. 6, the stabilizer 18 may be made from any suitable rigid material, such as a hard plastic. The stabilizer may extend between a proximal end 181 and a distal end 183. The proximal end 181 may include opposing stops 185 coplanar with the stabilizer 18 though perpendicularly extend from the proximal end 181. The distal end 183 may include a perpendicularly joined lip 187 out of plane with the stabilizer 18. The opposing stops 185 may catch on lateral elements 189 in the pocket 16 so as to be in a locked engagement in either or both the retracted position and the extended position.

Figure 2:
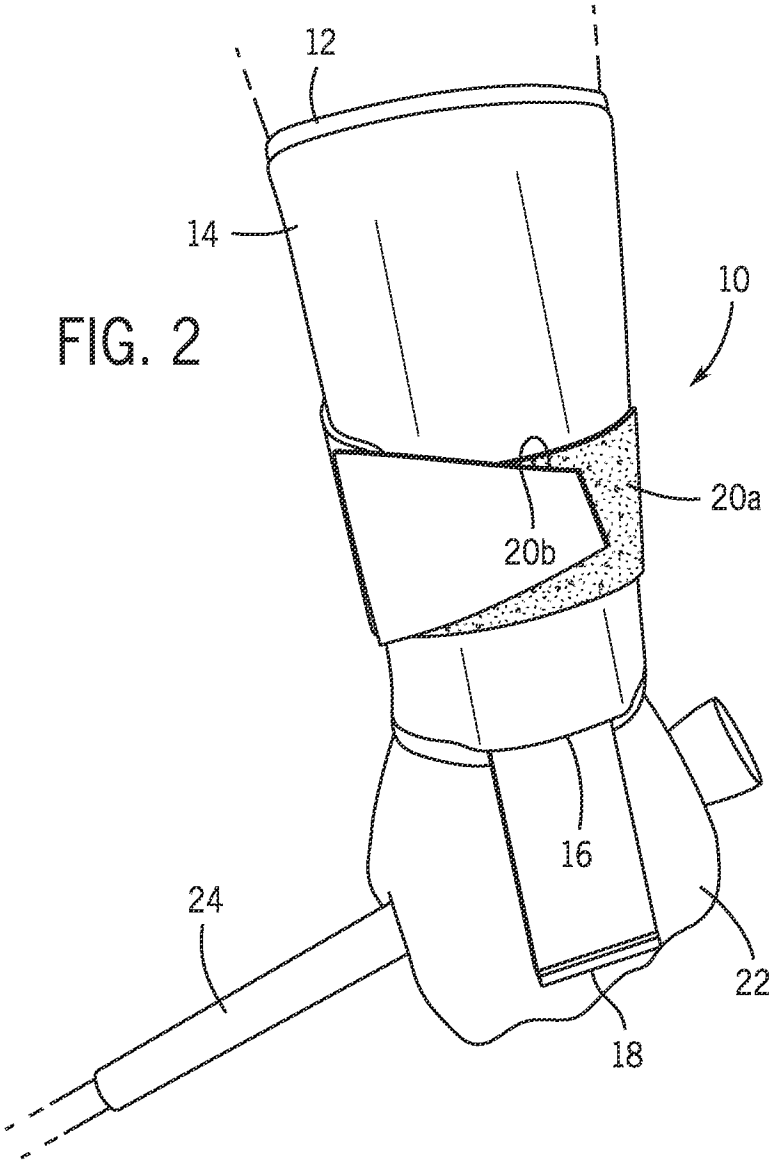
FIG. 2 is a perspective view of an exemplary embodiment of the present invention, shown in use in an extended position.
Figure 1:
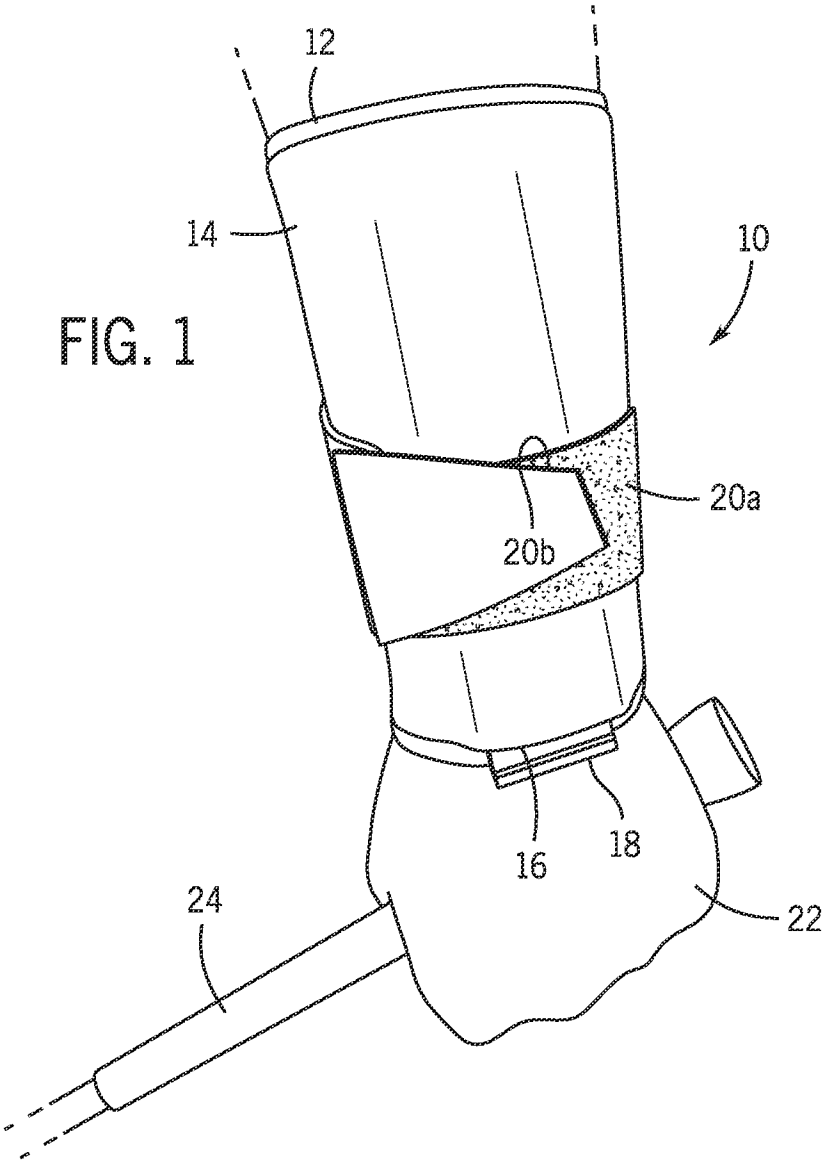
FIG. 1 is a perspective view of an exemplary embodiment of the present invention, shown in use in a retracted position.
Figure 4:
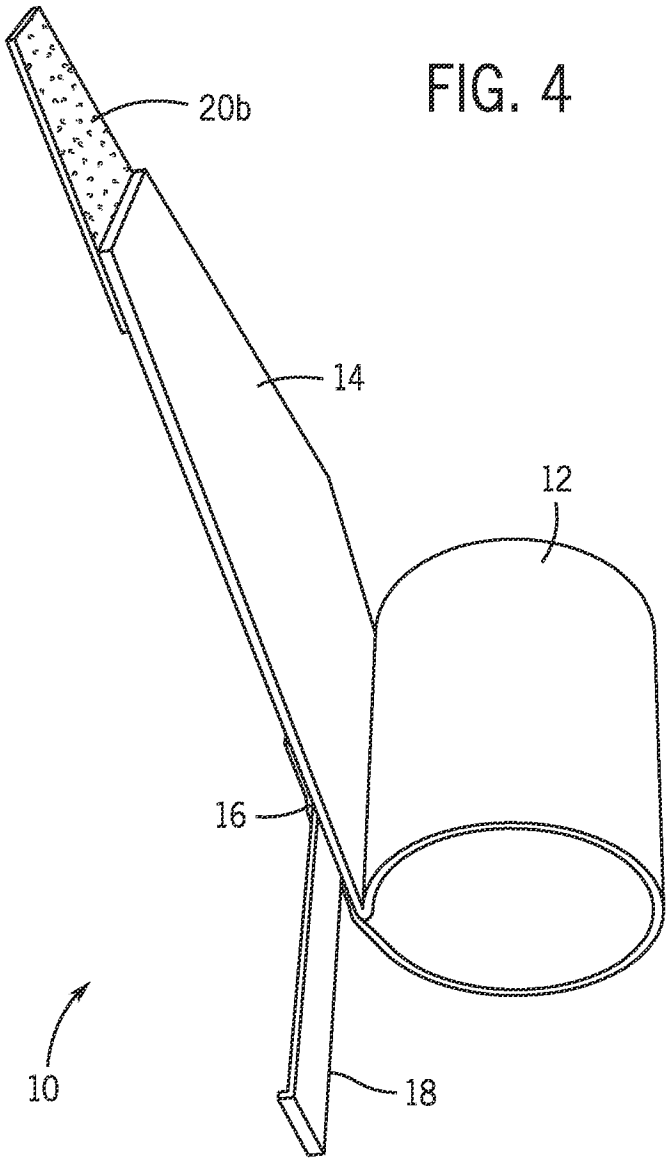
FIG. 4 is a front perspective view of an exemplary embodiment of the present invention, shown in the extended position.

A method of using the present invention may include the following. The golf aid 10 disclosed herein may be provided. The cuff portion 12 is placed around the wrist with the small opening toward the wrist and the large opening toward the elbow. The wrap portion 14 wraps around the wrist until the first and second connectors 20*a* and 20*b* connect, wherein the pocket 16 is disposed adjacent and just upward of a dorsal portion (as illustrated in FIG. 1) of the wrist. The stabilizer 18 may be moved to the extended position, with the aid of the lip 187, protruding up to approximately four inches from an opening of the pocket 16 toward the back of the hand and possibly up to the metacarpophalangeal joint/knuckles, preventing the wrist from pivoting anterior relative to the forearm. The stabilizer 18 is not necessarily touching the wrist while at the golfer 22 is at rest but will keep the wrist from unwanted bending during the swing of the golf club 24. As this is primarily a golf aid it is there as a reminder to keep the wrist straight and through muscle memory over time with practice the golfer will automatically keep the wrist straight.

The golfer would put the golf aid 10 on their leading wrist: for right hand golfers, it would be the left hand. They would swing the golf club normally during practice and on the golf course during play. The golf aid 10 would keep the wrist from anteriorly breaking a plane shared by a dorsal surface of the hand and the forearm when the club head contacts the ball. This in turn will allow for a straighter ball flight. Straighter ball flight allows more control over each golf shot. This in turn would keep the ball in play and reduce the amount of slicing, hooking, pulling, and pushing the ball caused by a hinged wrist at impact.

Additionally, the golf aid 10 could be used in a sport like tennis where the desire is to train the user to keep the wrist straight at impact.

As used in this application, the term "about" or "approximately" refers to a range of values within plus or minus 10% of the specified number. And the term "substantially" refers to up to 90% or more of an entirety.

It should be understood, of course, that the foregoing relates to exemplary embodiments of the invention and that modifications may be made without departing from the spirit and scope of the invention as set forth in the following claims.

What is claimed is:

1. A device comprising:

a cuff portion adapted to wrap around a wrist of a wearer so as to be fixed thereto;

a single pocket disposed along the cuff portion, wherein an opening of the pocket is disposed at a distal end of the pocket, said distal end adjacent carpal bones of said wearer; and a stabilizer having a distal lip, wherein the stabilizer is operatively associated with the pocket so that the distal lip moves relative the opening between a retracted position and an extended position forward of the carpal bones of said wearer, yet rearward relative to metacarpophalangeal joint of said wearer, and wherein the retracted position the distal lip is rearward of said carpal bones.

2. The device of claim 1, wherein a proximal end of the stabilizer includes two opposing stops coplanar with the stabilizer though perpendicularly extend from the proximal end for catching on the pocket at the extended position.

3. The device of claim 2, wherein the retracted position houses the stabilizer substantially in the pocket.

4. The device of claim 3, further comprising:

a wrap portion directly connected to the cuff portion in such a way as to be movable between an unwrapped condition and a wrapped condition;

a first connector disposed along an outer portion of the pocket at a middle third of a longitudinal length of the pocket, the first connector being spaced apart a third of said longitudinal length from the distal end and a proximal end, respectively, of the pocket to prevent lateral pivoting of the stabilizer; and a second connector disposed along an outer portion of the wrap portion, wherein the first connector and the second connector are attachable in the wrapped condition.

5. The device of claim 4, wherein the stabilizer and the pocket are elongated.

6. The device of claim 5, wherein the first connector spans the pocket for stabilizing the pocket.

7. The device of claim 6, wherein the first connector extends from a proximal portion on one side of a width of the pocket and a distal portion on an opposing side of the width of the pocket.

8. The device of claim 7, wherein the distal perpendicularly extends from and out of plane with a distal end of the stabilizer.

9. The device of claim 8, wherein a longitudinal length of the stabilizer is up to three inches.

10. The device of claim 9, further comprising lateral elements within the pocket for catching the two opposing stops.

* * * * *